United States Patent [19]

Sugiyama et al.

[11] Patent Number: 4,843,934

[45] **Date of Patent: * Jul. 4, 1989**

[54] RHYTHM TONE SOURCE ASSIGNING APPARATUS FOR USE IN ELECTRONIC MUSICAL INSTRUMENT

[75] Inventors: Jun Sugiyama; Akira Suzuki; Kosei Terada; Shigenori Oguri; Shigeki Ishii, all of Hamamatsu, Japan

[73] Assignee: Yamaha Corporation, Shizuoka, Japan

[ * ] Notice: The portion of the term of this patent subsequent to Jun. 16, 2004 has been disclaimed.

[21] Appl. No.: 29,753

[22] Filed: Mar. 24, 1987

Related U.S. Application Data

[62] Division of Ser. No. 870,090, Jun. 3, 1986, Pat. No. 4,672,876.

[30] Foreign Application Priority Data

Jun. 7, 1985 [JP] Japan ..... 60-123917
Feb. 14, 1986 [JP] Japan ..... 61-30513

[51] Int. Cl.[4] ..... G10H 1/42; G10H 7/00

[52] U.S. Cl. ..... 84/1.03; 84/1.24; 84/477 R; 84/DIG. 12

[58] Field of Search ..... 84/1.03, 1.17, 1.24, 84/477 R, 478, DIG. 12

[56] References Cited

U.S. PATENT DOCUMENTS 4,217,805 8/1980 Tamada ..... 84/1.03
4,481,853 11/1984 Ishikawa ..... 84/1.03

*Primary Examiner*—Stanley J. Witkowski
*Attorney, Agent, or Firm*—Spensley Horn Jubas & Lubitz

[57] ABSTRACT

A rhythm tone source assigning apparatus for use in an electronic musical instrument comprises a memory having a plurality of storing regions corresponding to a plurality of input operating manipulators each being comprised of a keyboard key or a switch. Arrangement is provided so that by writing a tone source identifying datum corresponding to desired one of a plurality of rhythm tone sources in one of the storing regions corresponding to an input operating manipulator one after another, rhythm tone sources can be assigned to the plurality of input operating manipulators. Thus, this electronic musical instrument greatly facilitates its user of his performing or inputting operations in a hand percussion or a rhythm sequence programming by using these manipulators. This is, for each rhythm, the user is able to obtain his favorite convenient arrangement of operating manipulators.

3 Claims, 13 Drawing Sheets

| CHANNEL NO. \ RHYTHM NO. | 1 (MARCH) | 2 (WALTZ) |
|---|---|---|
| 1 | TOP CYMBAL (1) | |
| 2 | HIGH HAT CYMBAL (4) | |
| 3 | SNARE DRUM (6) | |
| 4 | LIGHT SNARE DRUM (11) | |
| 5 | LIGHT BASS DRUM (15) | |
| 6 | CASTANET (17) | |
| 7 | PEDAL HIGH HAT (24) | |
| 8 | SNARE DRUM RIM SHOT (8) | |

RHYTHM TONE SOURCE ASSIGNING APPARATUS FOR USE IN ELECTRONIC MUSICAL INSTRUMENT

This is a division of application Ser. No. 870,090, filed June 3, 1986 now U.S. Pat. No. 4,672,876.

BACKGROUND OF THE INVENTION (a) Field of the invention

The present invention relates to a rhythm tone source assigning apparatus suitable for use in an electronic musical instrument, an automatic rhythm performing device, a rhythm sequencer and like devices to freely assign a plurality of rhythm tone sources to a plurality of input operating manipulators.

(b) Description of the prior art

There have been known in the past those rhythm performing devices which are arranged so that a plurality of different rhythm tone sources such as bass drum, snare drum and so forth are fixedly assigned to a corresponding plurality of input switches, respectively, and that, in accordance with the selective operation of these switches, there can be attained a hand percussion and/or a rhythm sequence programing.

In the conventional devices mentioned above, the rhythm tone sources to be designated have been fixedly assigned to the predetermined input switches, respectively, when manufactured, and accordingly these switches would appear for certain players of the device to be quite inconveniently arranged to operate. Also, such a distribution of switches may be noted by a same player to be inconvenient in performing certain types of rhythm such as march, waltz, swing and mambo.

SUMMARY OF THE INVENTION

It is, therefore, a primary object of the present invention to provide a rhythm tone source assigning apparatus for use in an electronic musical instrument, which solves the above-mentioned problems and inconveniences by an arrangement which makes it feasible to realize, whenever necessary, a most easily and conveniently operable arrangement or distribution of input operating manipulators to suit any type of rhythm performance or to meet the player's personal operational preference.

Another object of the present invention is to provide a rhythm tone source assigning apparatus of the type as mentioned above, which is arranged so that a manual rhythm performance can be effected for each selected rhythm by using rhythm tone sources suitable for such a selected rhythm.

Still another object of the present invention is to provide a rhythm tone source assigning apparatus of the type as mentioned above, which easily allows its player to easily carry out a complicated or quick style rhythm performance such as "trill".

Yet another object of the present invention is to provide a rhythm tone source assigning apparatus of the type as mentioned above, which is capable of realizing a rhythm performance with sufficiently many kinds of rhythm tone sources by operating a relatively small number of input operating manipulators.

According to the present invention, a rhythm tone source assigning apparatus is provided with a rhythm tone source assigning apparatus comprising: a plurality of input operating manipulators; memory means having a plurality of storing regions corresponding to said input operating manipulators, respectively; selecting means intended to select, from among a plurality of rhythm tone sources provided, those rhythm tone sources which are to be assigned; designating means for designating an input operating manipulator to which the selected rhythm tone source is assigned; and writing-in means for writing a tone source desingating datum corresponding to the rhythm tone source selected by the selecting means in that specific storing region of the memory means which corresponds to the designated one of the plurality of input operating manipulators, so that through the selection of a desired rhythm tone source by operating the selecting means and the designating means, it is possible to write a tone source designating datum corresponding to an arbitrarily intended tone source in the storing region of the memory means corresponding to one of the respective input operating manipulators. And, the tone source designating datum having been stored in each storing region is read out based on the selective operation of the input operating manipulators whereby the datum can be utilized in hand percussion (manual rhythm performance) or rhythm sequence programing (writing-in of a rhythm pattern).

The rhythm tone source assigning apparatus according to the present invention can further comprise rhythm selecting means for selecting a desired rhythm type, and assigning means for asssigning, designating means for designating an input operating manipulator to which the selected rhythm tone source is assigned when a rhythm tone source requiring its assignment has been selected, the selected one or ones of the rhythm tone sources of that rhythm type to a designated input operating manipulator or manipulators. This rhythm tone source assigning apparatus is provided with first and second memory means having mutually corresponding plurality of storing regions so that a rhythm tone source designating datum is written for each storing region in the first memory means in accordance with a selected rhythm type; whereas an operating manipulator, identifying datum corresponding to the identified input operating manipulator is written in the storing region of the second memory means bearing the same number as that of the storing region wherein a tone source designating datum corresponding to the rhythm tone source to be assigned has been stored. And, judgement is made whether the manipulator identifying datum corresponding to the identified operating manipulator has been written in the second memory means. If the result of this judgement is affirmative, the rhythm tone source designating datum corresponding to the judged manipulator identifying datum is read out from the first memory means.

According to the arrangement proposed by the present invention, a group of rhythm tone source designating data which are specified by a selected rhythm type are written in the memory means, and based on these registered data, rhythm tone source can be assigned to any arbitrary input operating manipulator. Accordingly, the selection of a rhythm tone source suitable for any rhythm can be made for each type of rhythm, and along therewith an arrangement of the operating manipulator for any rhythm can be realized for each type of rhythm.

Also, as stated above, by constructing the apparatus in such a way that in the first and second memory means, rhythm tone source designating data and operating manipulator identifying data are written in the mutually corresponding storing regions, respectively, of these two memory means, there is no need to provide a large number of storing regions intended for storing rhythm tone source designating data in correspondence to a large number of input operating manipulators, and thus memory capacity can be minimized.

These and other objects as well as the feature and the advantages of the present invention will be apparent from the following detailed description of the preferred embodiments when taken in conjunction with the accompanying drawings.

BRIEF DESCRPTION OF THE DRAWINGS

DETAILED DESCRIPTION OF THE PREFERRED EMBODIMENTS

Figure 1:
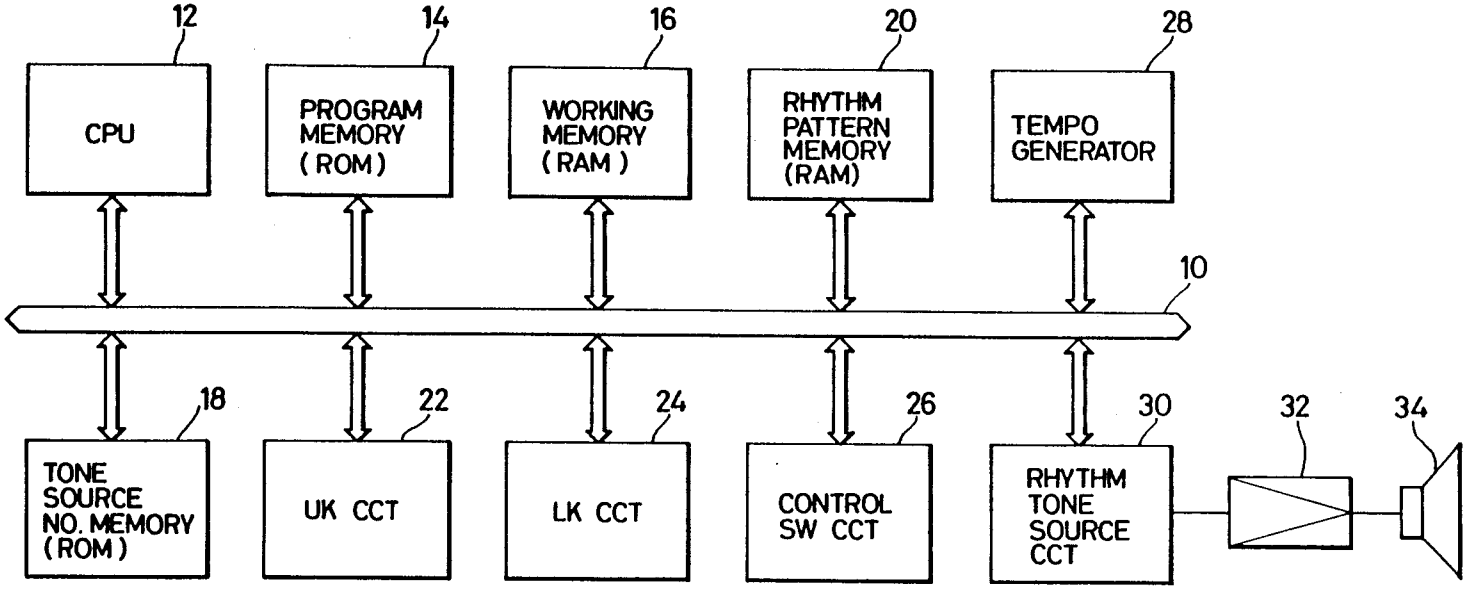
FIG. 1 is a block diagram showing the circuit arrangement of the electronic musical instrument according to an embodiment of the present invention.

FIG. 1 shows an embodiment wherein the present invention is applied to a dual keyboard type electronic musical instrument, and the selection of rhythm tone sources is carried out by upper keyboard keys and the production of each tone is assigned to a desired key on a lower keyboard. The electronic musical instrument of this instant embodiment is designed so that the generation of melodies, chords and so forth and the generation of rhythm tones are controlled by the aid of a microcomputer. Description will be made below with respect to the generation of a rhythm tone, and for the purpose of simplicity the description with respect to the generation of a melody, a chord and so forth will be omitted.

Circuit arrangement (FIG. 1)

To a common bus 10 are electrically connected a central processing unit (CPU) 12, a program memory 14, a working memory 16, a tone source number memory 18, a rhythm pattern memory 20, an upper keyboard circuit 22, a lower keyboard circuit 24, a control switch circuit 26, a tempo generator 28, a rhythm tone source circuit 30 and so forth.

The CPU 12 carries out various kinds of data processing concerning the generation of rhythm tones in accordance with the program stored in the program memory which is comprised of a ROM (Read-Only Memory). With respect to these respective types of processing, their detailed description will be made later by referring to FIGS. 4 to 7.

The working memory 16 is comprised of a RAM (Random Access Memory), and contains storing regions which are utilized as registers for various types of processing which are carried out through the CPU 12. The registers which are used for the generation of rhythm tones include those described in items (1) to (4) given below.

(1) Mode register MDREG

This register stores data indicative of various modes such as assigning mode and play mode. The assigning mode is one intended to assign a desired rhythm tone source to a desired key of the lower keyboard. Also, the play mode is one for effecting a manual rhythm performance (hand percussion), using the lower keyboard to a key of which has been assigned a rhythm tone source.

(2) Key assigning register KAREG

Figure 2:
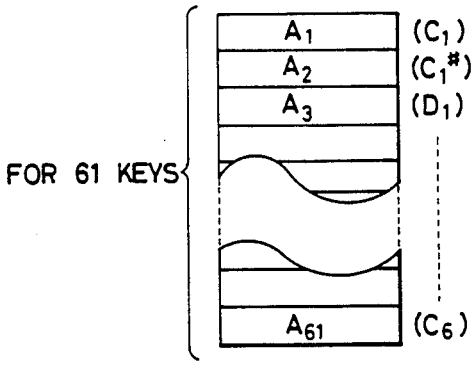
FIG. 2 is a format diagram showing an arrangement of storing regions in the key assignment register.

This register contains storing regions $A_1 \sim A_{61}$ corresponding to the sixty-one (61) keys for the $C_1 \sim C_6$ notes, respectively, provided on the lower keyboard as shown in FIG. 2. A tone source number datum is stored in each storing region, that is in correspondence to each key.

(3) Tone source number register SNOREG

This register is intended to store tone source number data read out from the tone source number memory 18.

(4) Tempo counter TCL

This counter counts tempo clock pulses delivered out from the tempo generator 28. It assumes a count value of $0 \sim 95$ for four (4) bars, and is reset at the arrival of timing at which the count value gains "96".

The tone source number memory 18 is comprised of a ROM, and stores tone source number data corresponding respectively to the sixty-one (61) keys of $C_2 \sim C_7$ notes of the upper keyboard. Here, an example of the correspondency between the respective keys of the upper keyboard and the tone source numbers is as follows.

| Key name | Tone source number |
|---|---|
| $C_2$ | 1 |
| $C_2$# | 0 |
| $D_2$ | 2 |
| $D_2$# | 0 |
| $E_2$ | 3 |
| $F_2$ | 4 |
| . | . |
| . | . |

-continued

| Key name | Tone source number |
|---|---|
| . | . |
| $B_6$ | 35 |
| $C_7$ | 36 |

In the above-mentioned example, it should be noted that, on the upper keyboard, a tone source number "0" which means "no tone source" is assigned to sharp notes keys, while tone numbers "1~36" are assigned to natural keys, respectively. Data of the respective tone source numbers are intended to identify the respective rhythm tone sources contained in the rhythm tone source circuit 30. An example of the correspondency between the respective tone source numbers and the tone source names is as mentioned below.

| Tone source numbers | Tone source names |
|---|---|
| 0 | None |
| 1 | Bass drum I |
| 2 | Bass drum II |
| 3 | Snare drum I |
| 4 | Snare drum II |
| 5 | Snare drum III |
| 6 | High hat I |
| 7 | High hat II |
| . | . |
| . | . |
| . | . |
| 36 | Cowbell |

Figure 3:
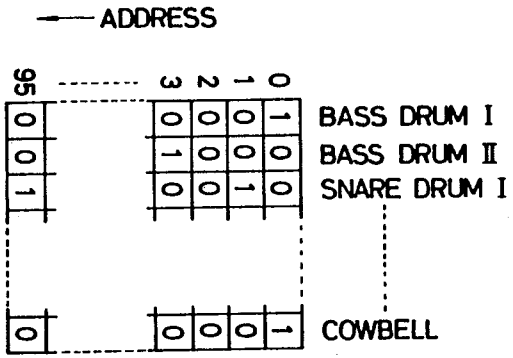
FIG. 3 is a data format chart of a rhythm pattern memory.

The rhythm pattern memory 20 is comprised of a RAM, and it can store a plurality of sets of such rhythm pattern data as those shown in FIG. 3. In FIG. 3, "0~95" represent addresses corresponding to the count values of the tempo counter TCL, and a datum for one tone-producing timing is stored for each address. The rhythm pattern data in each set contain data for ninety-six (96) tone-producing timings, representing a rhythm pattern for four consecutive bars. The datum for each one tone-producting timing is arranged so that the tone-production or non-tone-production of the thirty-six (36) rhythm tone sources corresponding to the abovesaid tone source numbers 1~36 are indicated by "1" and "0", respectively.

The upper keyboard circuit 22 contains key switches corresponding respectively to the sixty-one (61) keys of the upper keyboard. Arrangement is provided so that by scanning these key switches, the information concerning their key operation can be detected.

The lower keyboard circuit 24 contains key switches corresponding respectively to the sixty-one (61) keys of the lower keyboard. Arrangement is provided so that, by scanning these switches, their key operation informations can be detected.

The control switch circuit 26 contains, for example, mode selecting switches to appropriately select such modes as the assigning mode and the play mode, and also a start/stop switch to control the start/stop operation of an automatic rhythm performance. Arrangement is provided so that detection can be made of the information concerning operation indicating which one of these control switches has been actuated.

The tempo generator 28 is provided to enable an automatic rhythm performance. This generator is arranged so that, upon actuating said start/stop switch, the tempo generator is released of its reset state and commences the delivery of tempo clock pulses. Each tempo clock pulse functions so as to start the interrupt routine operation shown in FIG. 7. By the repetition of this interrupt routine operation, a rhythm tone can be produced automatically in accordance with the rhythm pattern stored in the memory 20.

The rhythm tone source circuit 30 contains thirty-six (36) rhythm tone sources corresponding in number to the abovesaid tone source numbers 1~36. By selectively driving these rhythm tone sources, a rhythm tone signal can be generated.

A rhythm tone signal generated from the rhythm tone source circuit 30 is supplied via an output amplifier 32 to a loudspeaker 34 to be converted to an audible sound.

Figure 4:
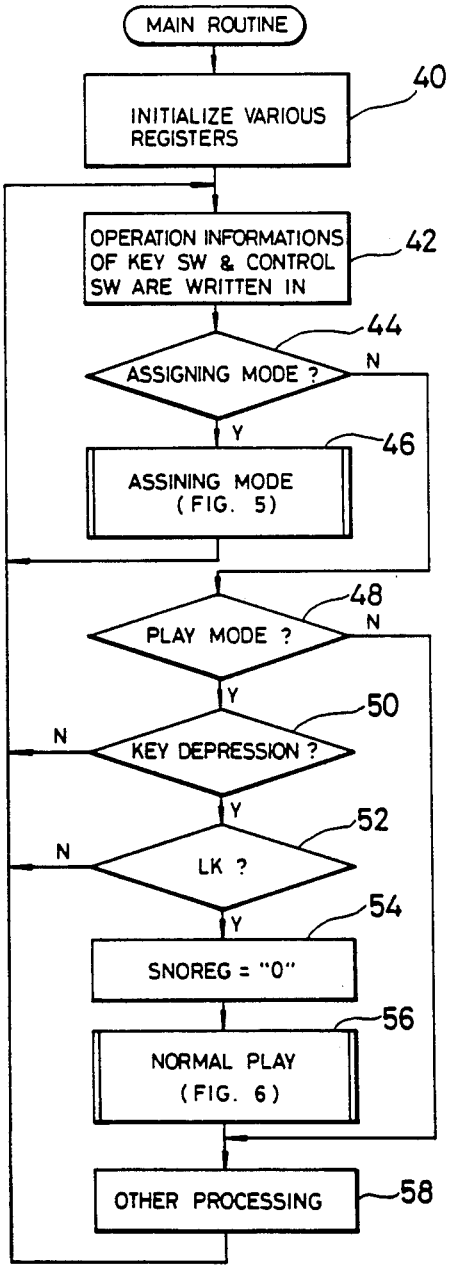
FIG. 4 is a flow chart of a main routine operation.

Main routine operation (FIG. 4)

FIG. 4 shows the flow of a main routine processing.

To begin with, a power supply switch not shown is turned on. Whereupon, the main routine operation of FIG. 4 commences. More particularly, in Step 40, various registers and so forth as stated above are initialized. For example, the mode register MDREG, the key assigning register KAREG and the tone source number register SNOREG are invariably cleared, while the tempo counter TCL is set with a count value of "95".

Next, in Step 42, the informations concerning the operation of the abovesaid key switches and control switches are written in the working memory 16, and with respect to the mode selecting switch, in particular, a datum corresponding to the selected mode is stored in the mode register MDREG. With this, processing advances onto Step 44.

Figure 5:
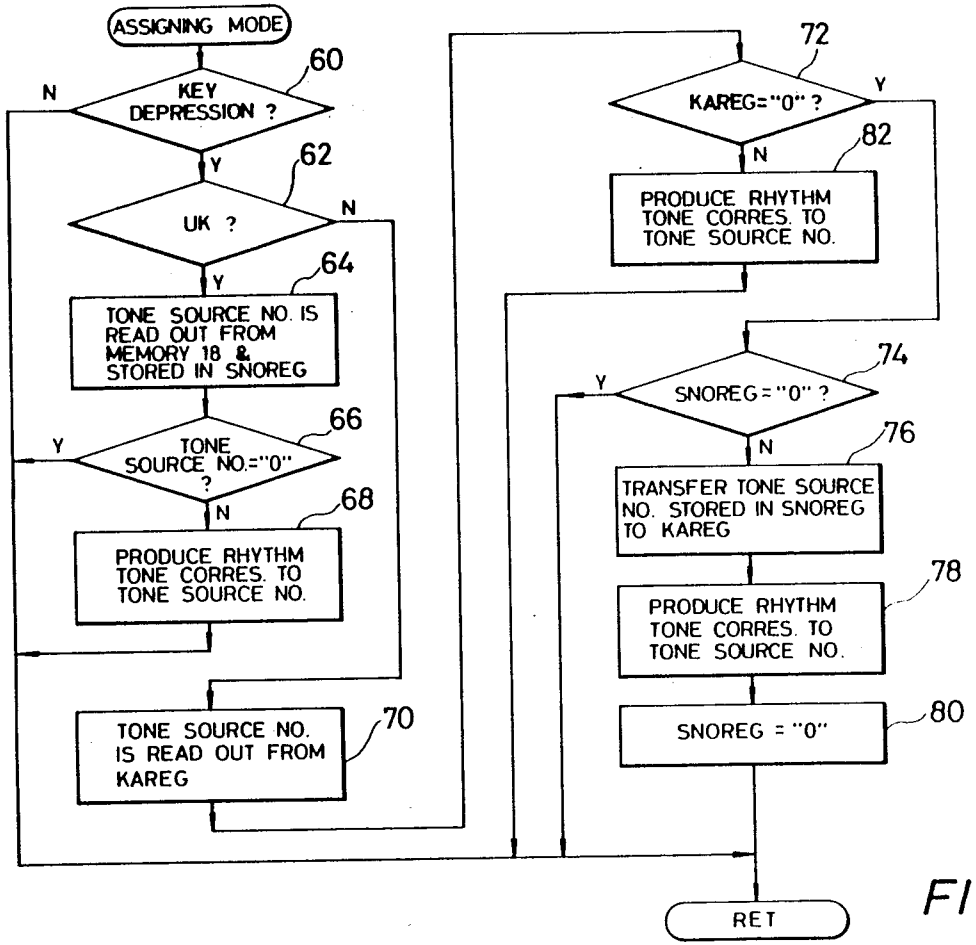
FIG. 5 is a flow chart of a subroutine operation of the assignment mode.

In Step 44, the mode register MDREG is checked to judge whether the mode indicates the assigning mode. If the result of this judgement is Yes (Y), the processing moves over to Step 46 wherein the sub-routine operation as the assigning mode shown in FIG. 5 is carried out. With this, the processing returns to Step 42. Also, if the result of judgement is No (N), processing moves onto Step 48.

In Step 48, the mode register MDREG is checked to judge whether the play mode is indicated. If the result of this judgement is Yes (Y), processing moves to Step 50, wherein judgement is made whether there has been a key depression. If the result of this judgement is No (N) which indicates no key depression, processing returns to Step 42, while if the judgement is Yes (Y) indicating the presence of a key depression, processing moves onto Step 52.

In Step 52, judgement is made whether the keyboard whose key has been depressed is the lower keyboard (LK). If the result of this judgement indicates that it is not the lower keyboard LK, (N), this means the upper keyboard (UK), so that processing returns to Step 42. If the LK is indicated, (Y), processing moves to Step 54, wherein the register SNOREG is cleared to "0". This is an initial setting processing for the next Step 56.

Figure 6:
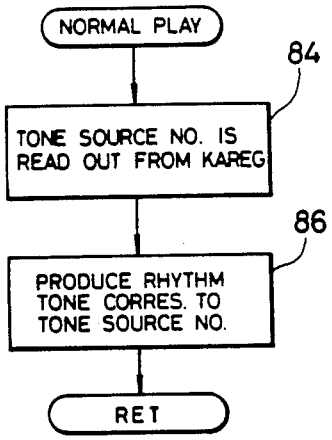
FIG. 6 is a flow chart of a subroutine operation of normal play.

In Step 56, a sub-routine operation as the normal play shown in FIG. 6 is carried out, and thereafter processing moves onto Step 58. If, however, the judgement made in Step 48 does not indicate the play mode, (N), processing moves onto Step 58 without passing through Steps 50~56.

In Step 58, other kinds of processing are carried out. Here, said other kinds of processing include, in addition to the normal play, the write play mode processing capable of writing a rhythm pattern in the memory 20. Such a processing will be described later. Subsequent to Step 58, processing returns to Step 42, and those kinds of processing as mentioned above are repeated.

Assigning mode sub-routine operation (FIG. 5).

FIG. 5 shows the flow of processing carried out in the assigning mode sub-routine (Step 46 in FIG. 4).

To begin with, in Step 60, judgement is made whether there has been a key depression. If there has been no key depression, (N), processing returns to the main routine operation (RET). Also, if there has occurred a key depression, (Y), processing moves to Step 62.

In Step 62, judgement is made whether the keyboard where a key depression has taken place is the upper keyboard (UK). In this embodiment, arrangement is provided so that the rhythm tone source, selected on UK is assigned to a desired key on LK, and accordingly there is the necessity that UK be operated first. If the result of judgement made in Step 62 indicates UK that a key depression has taken place, (Y), processing moves onto Step 64.

In Step 64, the tone source number datum corresponding to the depressed key is read out from the memory 18, and this datum is stored in the register SNOREG.

Next, in Step 66, judgement is made whether the value of the tone source number datum (i.e. the tone number) having been stored in the register SNOREG is "0". As stated above, in the upper keyboard, sharp note keys are assigned with the tone source number "0", and accordingly the judgement in Step 66 will result in the judgement whether the depressed key is the sharp note key. If the result of this judgement is affirmative, (Y), this means that there is no rhythm tone source which is to be driven, so that processing will return to the main routine operation. Also, if the result of the judgement in Step 66 is negative, (N), processing moves over to Step 68.

In Step 68, the tone source number datum contained in the register SNOREG is transferred to the rhythm tone source circuit 30 to drive the rhythm tone source corresponding to said tone source number datum. As a result, from the loudspeaker 34 is sounded out a tone of the musical instrument (e.g. if the depressed key is $C_2$, the tone of bass drum I) corresponding to the depressed natural key, whereby indicating that a specific rhythm tone source has been selected. And, subsequent to Step 68, processing returns to the main routine operation.

Thereafter, when a desired key on the lower keyboard is depressed, the result of judgement made in Step 62 becomes negative, (N), and processing moves onto Step 70.

In Step 70, a tone source number datum is read out from a storing region of the register KAREG corresponding to the depressed key. And, processing moves to Step 72.

In Step 72, judgement is made whether the value of the datum stored in KAREG corresponding to the depressed key is "0". This judgement is intended to check whether assignment to the lower keyboard has already been effected. In the example mentioned above, only a rhythm tone source has been selected on the upper keyboard, and no assignment thereof to the lower keyboard has yet been effected. Accordingly, the result of judgement made in Step 72 becomes affirmative, (Y), and processing moves onto Step 74.

In Step 74, judgement is made whether the value of the register SNOREG is "0". This judgement is intended to check whether the rhythm tone source which requires assignment has been selected already. If the result of judgement is "0" which means (Y), this indicates that no rhythm tone source has yet been selected Therefore, processing returns to the main routine operation. Also, in case the selection of a rhythm tone source has been selected as stated above, the result of judgement in Step 74 becomes negative, (N), so that processing moves onto Step 76.

In Step 76, a tone source number datum contained in the register SNOREG (i.e. the tone source number datum corresponding to the selected rhythm tone source) is transferred to the storing region in the register KAREG corresponding to the depressed key (i.e. the storing region same as that from which the tone source number datum has been read out in Step 70), and the transferred datum is stored therein. As a result, a specific rhythm tone source selected on the upper keyboard is now assigned to a desired key of the lower keyboard.

Next, in Step 78, the tone source number datum assigned in Step 76 is read out from the register KAREG, and it is transferred to the rhythm tone source circuit 30 to drive a rhythm tone source corresponding to the said tone source number datum to produce the tone. As a result, a tone of the instrument (which, in the above-mentioned example, is a tone of bass drum I) which has been assigned to the depressed key on the lower keyboard is pronounced from the loudspeaker 34, whereby to indicate that the desired rhythm tone source has been assigned. Subsequent to Step 78, processing advances onto Step 80.

In Step 80, because the assignment for one key has completed, the register SNOREG is cleared to "0", and thereafter processing returns to the main routine operation.

Thereafter, in a manner same as that mentioned above, it is possible to select a rhythm tone source with respect to any other key of the lower keyboard and to make its assignment. In this case, when a already assigned key on the lower keyboard is depressed, the result of judgement in Step 72 becomes negative, (N), and processing moves to Step 82.

In Step 82, the tone source number datum which is read out from the storing region in the register KAREG corresponding to the depressed key is supplied to the rhythm tone source circuit 30 to thereby drive the rhythm tone source corresponding to said tone source number datum to produce the tone. As a result, a tone of the musical instrument corresponding to the already assigned key is pronounced from the loudspeaker 34, whereby indicating the completion of assignment. Subsequent to the processing in Step 82, processing returns to the main routine operation. Accordingly, in this case it is not possible to make re-assignment to the already assigned key. However, one may change the contents of the routine to enable re-assignment.

After a desired rhythm tone source has been assigned for each key on the lower keyboard in such a way as mentioned above, it is possible to select the play mode by manipulating the mode selecting switch, and to effect a manual rhythm performance by a depressing a key on the lower keyboard.

Normal play sub-routine operation (FIG. 6)

FIG. 6 shows the flow of processing in the normal play sub-routine operation (i.e. Step 56 in FIG. 4). It is as stated above that this instant routine is carried out based on a key depression on the lower keyboard during the play mode.

In Step 84, a tone source number datum is read out from the storing region in the register KAREG corresponding to the depressed key. With this, processing moves to Step 86.

In Step 86, the tone source number datum thus read out is supplied to the rhythm tone source circuit 30 to thereby drive the rhythm tone source corresponding to the said tone source number datum. As a result, a tone of the musical instrument corresponding to the depressed key is generated from the loudspeaker 34. Thereafter, processing returns to the main routine operation.

Accordingly, in case the play mode is selected, it is possible to make an arbitrary rhythm performance by a key depressing operation on the lower keyboard. In this case, a melody can be played on the upper keyboard. Therefore, the player may play a melody on the upper keyboard, and make a rhythm performance on the lower keyboard as an accompaniment thereof. It should be noted here that, in case a rhythm different from the preceding one is to be performed, the player may select the assigning mode, and alter the rhythm tone source assignment so as to meet the selected rhythm which is to be performed.

Now, in case the write-play mode is selected by manipulating the mode selecting switch, a manual rhythm performance is feasible in a manner same as that described above, and along therewith a rhythm pattern corresponding to the contents of such manual rhythm performance can be written in the memory 20 in such a way as shown in, for example, FIG. 3. In this case, in the memory 20 is written "1" with respect to the pronounced rhythm tone source and "0" for the non-pronounced rhythm tone source, at each tone-producing timing corresponding to each address.

Subsequent to writing a desired rhythm pattern in the memory 20, the player may turn the start/stop switch on to commence an automatic rhythm performance based on a pattern stored in the memory 20.

Figure 7:
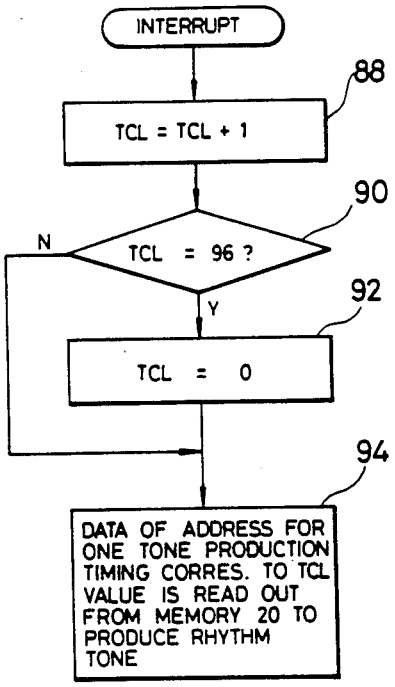
FIG. 7 is a flow chart of an interrupt routine operation.

Interrupt routine operation (FIG. 7)

FIG. 7 shows the flow of the interrupt routine processing which makes an automatic rhythm performance feasible. It is as stated above that this instant routine operation is commenced for each delivery of a tempo clock pulse from the tempo generator 28.

When, following the turn-on of the start/stop switch, a first tempo clock pulse is generated from the tempo generator 28, an initial interrupt processing is carried out. More particularly, in Step 88, the count value of the tempo counter TCL is upped by "one". Since a count value of "95" is set initially in the tempo counter TCL. the count value of this counter will become "96".

Next, in Step 90, judgement is made whether the count value of TCL is "96". Since the count value is presently "96", (Y), processing moves to Step 92 to clear the count of TCL down to "0". And, processing moves over to Step 94.

In Step 94, a data of the address for one tone-producing timing corresponding to the count value (in this case "0") of the tempo counter TCL are read out from the memory 20, and the data are supplied to the rhythm tone source circuit 30, to thereby drive the specific rhythm tone source corresponding to "1" contained in the data thus read out. As a result, from the loudspeaker 34 is sounded out a tone of the musical instrument such as bass drum I, cowbell, etc. in the example of FIG. 3.

Thereafter, when a second tempo clock pulse is delivered out from the tempo generator 28, the count value of the tempo counter TCL becomes "1" in Step 88. For this reason, the result of judgement in Step 90 becomes negative, (N), and processing moves onto Step 94.

In Step 94, in a manner similar to that of the preceding practice, data for one tone-producing timing are read out from the memory 20 to thereby drive a rhythm tone source to produce the tone, and a tone of a musical instrument such as snare drum I in the example of FIG. 3 is sounded out.

Thereafter, for each delivery of a tempo clock pulse, such an interrupt processing as mentioned above is repeated. Accordingly, based on a pattern stored in the memory 20, a rhythm performance will progress automatically. Upon completion of a performance for four (4) bars, a similar rhythm performance is repeated starting at the beginning of the first bar. It should be noted here that, in case the automatic rhythm performance is to be ceased, it is only necessary to turn the start/stop switch on once again.

In the above-mentioned embodiment, arrangement is provided so that the key on the lower keyboard to which a rhythm tone source has been assigned is utilized for the purpose of either producing a tone of a musical instrument or registering a rhythm pattern. It should be noted here, however, that such a key may be utilized also for erasing a tone-producing command "1" out of the rhythm pattern which has been written in the memory 20. To this end, it is only necessary to arrange, for example, so that when, after the selection of the erasing mode by manipulation of the mode selecting switch, a desired address is designated and a desired key of the lower keyboard is depressed, the bit position corresponding to this specific key will become "0".

Also, in the above-described embodiment, the upper keyboard is employed as the means for selecting a rhythm tone source which is to be assigned, and keys of the lower keyboard are used to serve as the input operating manipulators to which the selected rhythm tone source is to be assigned. This arrangement may be replaced by another one wherein a single keyboard is divided into two sections extending side-by-side in the lengthwise direction thereof so that the keys of one of the divided sections of this keyboard are utilized for the selection of a rhythm tone source and the keys of the other of the divided sections of the keyboard are used for the input operation.

Furthermore, it should be noted that the tone source selecting minipulators or input operating manipulators are not limited to a keyboard, but instead they may be comprised of push-button type switches or pressure-sensitive switches, or like switch means.

Figure 8:
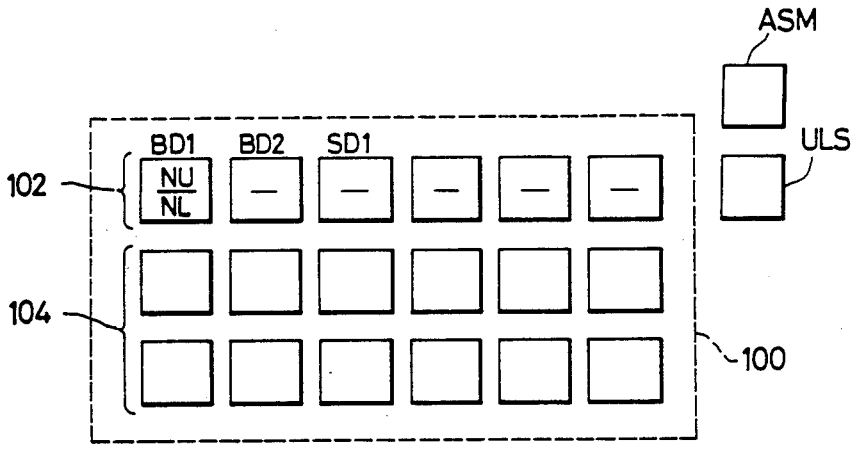
FIG. 8 is a diagrammatic illustration of a panel layout employed in according to another embodiment.

FIG. 8 shows another embodiment that the present invention is applied to a rhythm performing apparatus like a rhythm sequencer having a panel face, and indicates especially the layout of switches provided on the panel face.

Eighteen (18) input switches which are contained in an input operating switch group 100 are fixedly assigned with eighteen (18) rhythm tone sources such as bass drum I (BD1), bass drum II (BD2), snare drum I(SD 1), . . . , respectively. By selectively operating these input operating switches, it is possible to effect a manual rhythm performance or to carry out the registering of a rhythm pattern.

In such an arrangement as mentioned above, there are provided an assigning mode setting switch ASM and a tone source name changeover switch ULS in the vicinity of the input switch group 100. When the assigning mode setting switch ASM is turned on, the assigning mode is brought about in such a way that, in the input switch group 100, the six (6) input switches provided in a specific one row 102 of this group will function as rhythm tone source selecting switches, while the twelve (12) input switches in the other two rows 104 will function as input operating manipulators. In this case, mutually different rhythm tone source names NU and NL are inscribed in parallel on the surfaces of the respective operating manipulators for each of the input switches contained in the row 102. Unless the tone source name changeover switch ULS is turned on, the user can select a tone source name NU, and when the switch ULS is turned on, a tone source name NL can now be selected. Accordingly, when the tone source name changeover switch ULS is used, the user is able to make selective designation of twelve (12) rhythm tone sources one after another by actuating only six input switches of the row 102.

In the assigning mode, in a manner similar to that described in the case of the abovesaid embodiment, an arbitrary rhythm tone source is selected first by operating any one of the six input switches in the row 102, and then an input switch in the row 104 is actuated, whereby it is possible to assign a desired arbitrary rhythm tone source to any one of the respective input switches in the row 104. And, after the completion of assignment, an input switch in the row 104 is used to effect a manual rhythm performance or registering of a rhythm pattern.

Figure 9:
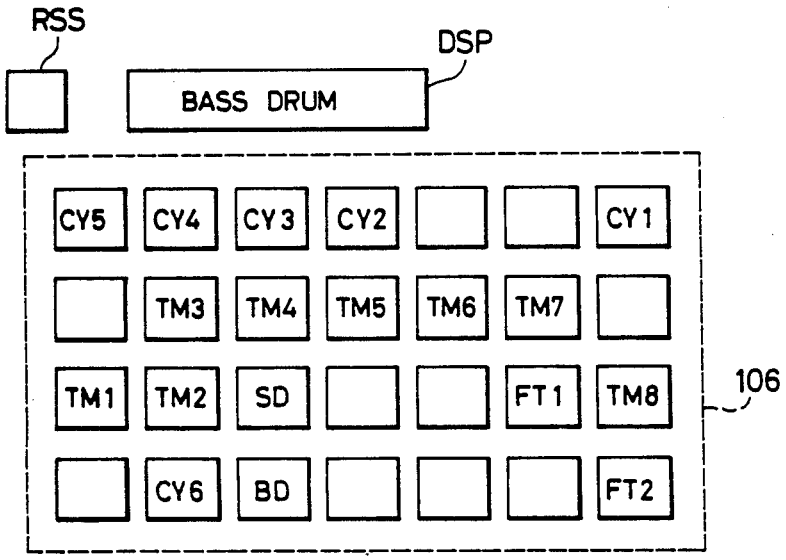
FIG. 9 is a diagrammatic illustration of a panel layout employed in still another embodiment.

FIG. 9 shows a rhythm performing apparatus having a panel face similar to a personal computer according to still another embodiment of the present invention, and illustrates especially a switch arrangement on the panel face.

An input switch group 106 contains a number of input switches which are disposed in a matrix form. In the vicinity of this input switch group 106 are provided a rhythm tone source selecting switch RSS and a tone source name display DSP.

In the assigning mode, a specific rhythm tone source name such as "bass drum" is initially displayed on the tone source name indicator DSP. Arrangement is provided so that, for each actuation of the rhythm tone source selecting switch RSS, a different rhythm tone source name is displayed thereon one after another.

When a desired tone source name is being displayed on the tone source name display DSP, let us suppose that a desired input switch contained in the input switch group 106 is turned on. Whereupon, a rhythm tone source corresponding to the tone source name which is being displayed is assigned to this actuated input switch. In this way, it is possible to assign an arbitrary rhythm tone source to any one of the input switches provided in the input switch group 106.

FIG. 9 shows an example of rhythm tone source assignment to the individual input switches provided in the input switch group 106. In this instant example, rhythm tone source assignment is made in such a fashion as to correspond to an arrangement of percussion instruments on a stage performance. More particularly, rhythm tone source assignment is effected in such a layout as illustrated, wherein BD represents bass drum, SD snare drum, FT1 and FT2 floor tams, TM1~TM8 eight tams, and CY1~CY6 cymbals.

By such a pattern of rhythm tone source assignment, it will be noted that, at the time of effecting a manual rhythm performance or registering of a rhythm pattern, the user is able to operate switches while bearing in mind the arrangement of respective percussion instruments on the stage. Thus, smooth switching operations become feasible.

For example, by arranging so as to allow switching-over rhythm tone sources from one to another, the user is able to alter only the tone sources while still sticking to the currently used rhythm pattern. As stated, the user may coercively set tone sources through eight (8) different channels, and from among them they are freely assigned to desired keys. In both embodiments the user is equally able to freely alter the keys to which the tone sources are to be assigned.

Figure 10:
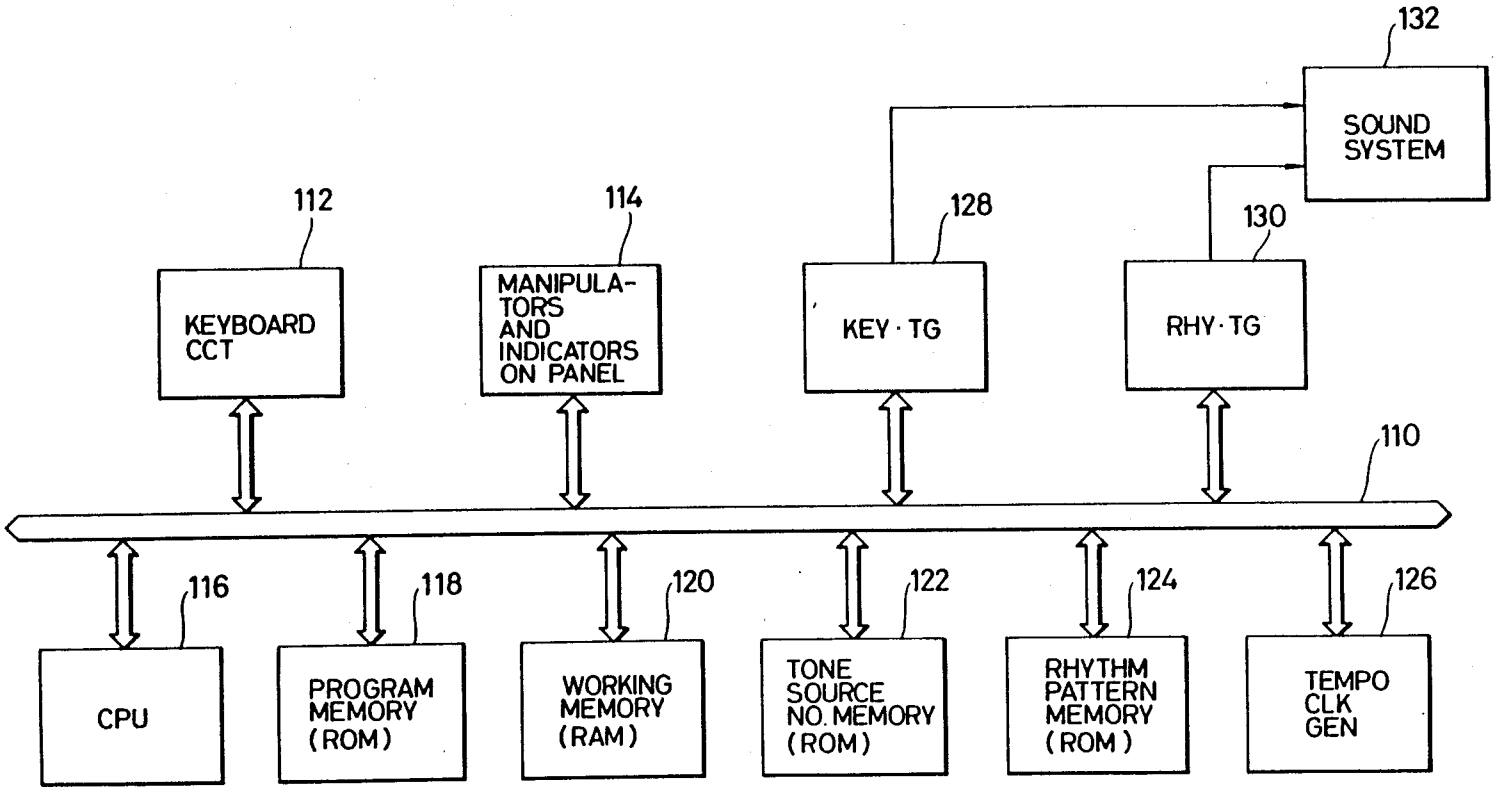
FIG. 10 is a block diagram showing a circuit arrangement of an electronic musical instrument provided with a rhythm performing unit according to yet another embodiment of the present invention.

FIG. 10 shows a circuit arrangement of an electronic musical instrument provided with a rhythm performing apparatus according to yet another embodiment of the present invention. This electronic musical instrument is constructed so that the production of tones such as keyboard performance tones, manual rhythm (hand percussion) tones, automatic rhythm tones or like tones is controlled by means of a microcomputer.

Circuit arrangement (FIG. 10)

To a common bus 110 are electrically connected a keyboard circuit 112, operating manipulator-display group 114 provided on a panel face, central processing unit (CPU) 116, a program memory 118, a working memory 120, a tone source number memory 122, a rhythm pattern memory 124, a tempo clock generator 126, a key tone generator (KEY·TG) 128 and a rhythm tone generator (RHY·TG) 130.

The keyboard circuit 112 contains an upper keyboard, a lower keyboard and a foot pedal manual, and it is arranged so that key operation informations are detected for each key of each keyboard or manual.

The operating manipulator and display group 114 provided on the panel face contains a number of operating manipulators and display intended for tone control and performance control. Among these manipulators and display, those related to the practicing of the present invention are shown in FIG. 11.

Figures 11, 12:
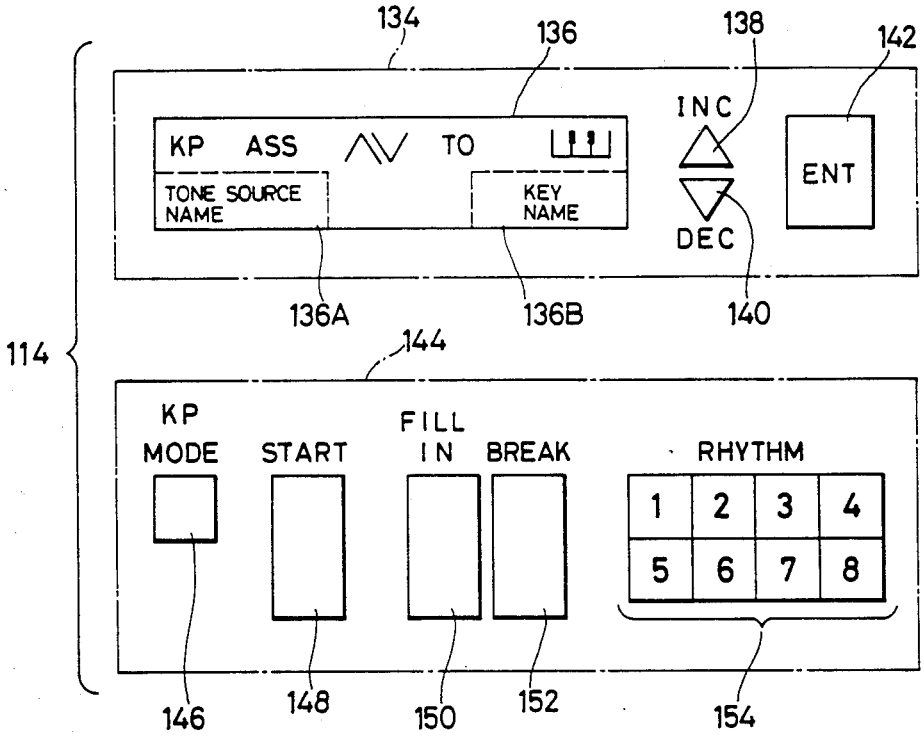
FIG. 11 is a diagrammatic illustration of a panel layout of the above-mentioned electronic musical instrument, showing a group of operating manipulators and indicators.
FIG. 12 is a diagrammatic illustration showing the contents stored in the tone source number memory in connection with rhythm number and channel number.

In FIG. 11, a multiple menu control unit 134 is provided with a multiple menu display 136 including a tone source name display section 136A and a key name display section 136B, an increment switch 138, a decrement switch 140 and an enter switch 142. A rhythm control unit 144 is provided with a key percussion (KP) mode selecting switch 146 intending a hand percussion performance using a keyboard key or keys, a rhythm start switch 148, a fill-in switch 150, a break switch 152 and eight (8) rhythm selecting switches generally indicated at 154.

The CPU 116 is intended to carry out various types of control processing for the generation of various tones the assignment of rhythm tone sources and like operations in accordance with the program stored in the program memory 118 which is comprised of a ROM (Read-Only Memory). The details of these processing operations will be described later by referring to FIGS. 13 to 19.

The working memory 120 is comprised of a RAM (Random Access Memory), and contains a large number of storing regions which are utilized as registers, flags and so forth during various kinds of processing done through the CPU 116. Among these registers, flags and the like, those related to the practicing of the present invention will be described later.

The tone source number memory 122 is comprised of a ROM, and as shown of its example in FIG. 12, it stores tone source number data corresponding to each of the eight (8) rhythm tone sources which are used in the performance of the respective rhythms. In FIG. 12, channel numbers "1~8" represent eight (8) tone-producing channel numbers contained in RHY·TG 130. Rhythm numbers "1, 2, . . . " represent the numbers corresponding to the rhythms "march", "waltz", . . . , respectively. The tone source numbers are predetermined for each rhythm tone source. One concrete example thereof is shown by the parenthesized numerical figures for respective rhythm tone source names contained in the column of "march" at rhythm number "1". For example, the tone source number for "top cymbal" is (1).

The rhythm pattern memory 124 is comprised of, for example, a ROM, and stores rhythm patterns for normal play and fill-in mode for each kind of rhythm. The data format of each rhythm pattern is of such a structure that event data indicative of tone source number and tone-producing timing are arranged in successive order in accordance with the progression of performance of, for example, one bar, so that by reading out the event data in accordance with an interrupt routine (not shown), an automatic rhythm performance can be realized.

The tempo clock generator 126 is intended to generate tempo clock pulses. Each of the tempo clock pulses is utilized as an interrupt command signal for starting an interrupt routine operation.

The KEY·TG 128 is intended to generate a tone signal corresponding to the key depressed on each keyboard or manual.

The RHY·TG, 130 is utilized in a manual rhythm performance and an automatic rhythm performance, and it possesses eight (8) time-divisional tone-producing channels for generation of rhythm tone signals. To these tone-producing channels are assigned rhythm tone sources for each kind of rhythm based on such a correspondency as exemplarily mentioned with respect to "march" in FIG. 12. Since this RHY·TG 130 has eight (8) tone-producing channels, it is possible to produce a maximum of eight (8) tones simultaneously at one tone-producing timing.

Tone signals delivered from the KEY·TG 128 and from the RHY·TG 130 are supplied to a sound system 132 to be converted to audible sounds.

Registers of the working memory 120

Among the various registers of the working memory 120, those which are used for the control of rhythm tone source assignment and for the production of rhythm tones are enumerated as follows.

(1) Rhythm run flag RUN

This is a one-bit register, and is arranged so that when a rhythm start switch 148 is turned on when the bit is "0", "1" is set therein, whereas by turning this switch 148 on when the bit is "1", "0" is set therein.

(2) KP mode flag KPF

This is a one-bit register which is constructed so that if a KP mode selecting switch 146 is turned on when the bit indicates "0", "1" is set, whereas by actuating the same switch 146 when the bit is "1", "0" is set.

(3) Assigning mode flag ASF

This is a one-bit register, and is so arranged that when the KP mode is being selected (i.e. when KPF="1"), either "1" or "0" is set in accordance with the operation of an enter switch 142.

(4) Break flag BRKF

This is a one-bit register which is constructed so that by turning a break switch 152 on, "1" is set therein.

(5) Key code register KEY

This register is intended to store a key code datum corresponding to a specific key having a key-on event. When there has occurred a key-on event on a plurality of keys, a key code datum corresponding to the lowest note key among them is stored.

(6) Rhythm number register RHYNO

This register is intended to store the rhythm number datum corresponding to a selected rhythm. Rhythm numbers are preliminarily determined for each kind of rhythm in such a way that "march" is represented by "1", and "waltz" is represented by "2" as shown exemplarily in FIG. 12.

(7) Rhythm buffer RHYBUF

This is a 4-bit register, and is intended to store, in its most significant bit (MSB), a datum indicative of either the normal or fill-in pattern, and to store, in the remaining three bits, the rhythm number datum corresponding to the selected rhythm.

(8) Tone source number registers $SNOREG_1$~-$SNOREG_8$

These registers are intended to store tone source number data for eight (8) tone sources read out from the tone source number memory 122 in accordance with the selected rhythm. The registers $SNOREG_1$~-$SNOREG_8$ correspond to channel numbers "1~8", respectively.

(9) Assigning key code registers $KAREG_1$ $KAREG_8$

These registers are intended to store key code data for eight (8) keys when a rhythm tone source is assigned to a key which serves as an input operating manipulator. The registers $KAREG_1$~$KAREG_8$ correspond to the registers $SNOREG_1$~$SNOREG_8$, respectively.

(10) Rhythm pattern reading-out address pointer RHPNT

This is an address register for use in reading out a datum from the rhythm pattern memory 124.

Figure 13:
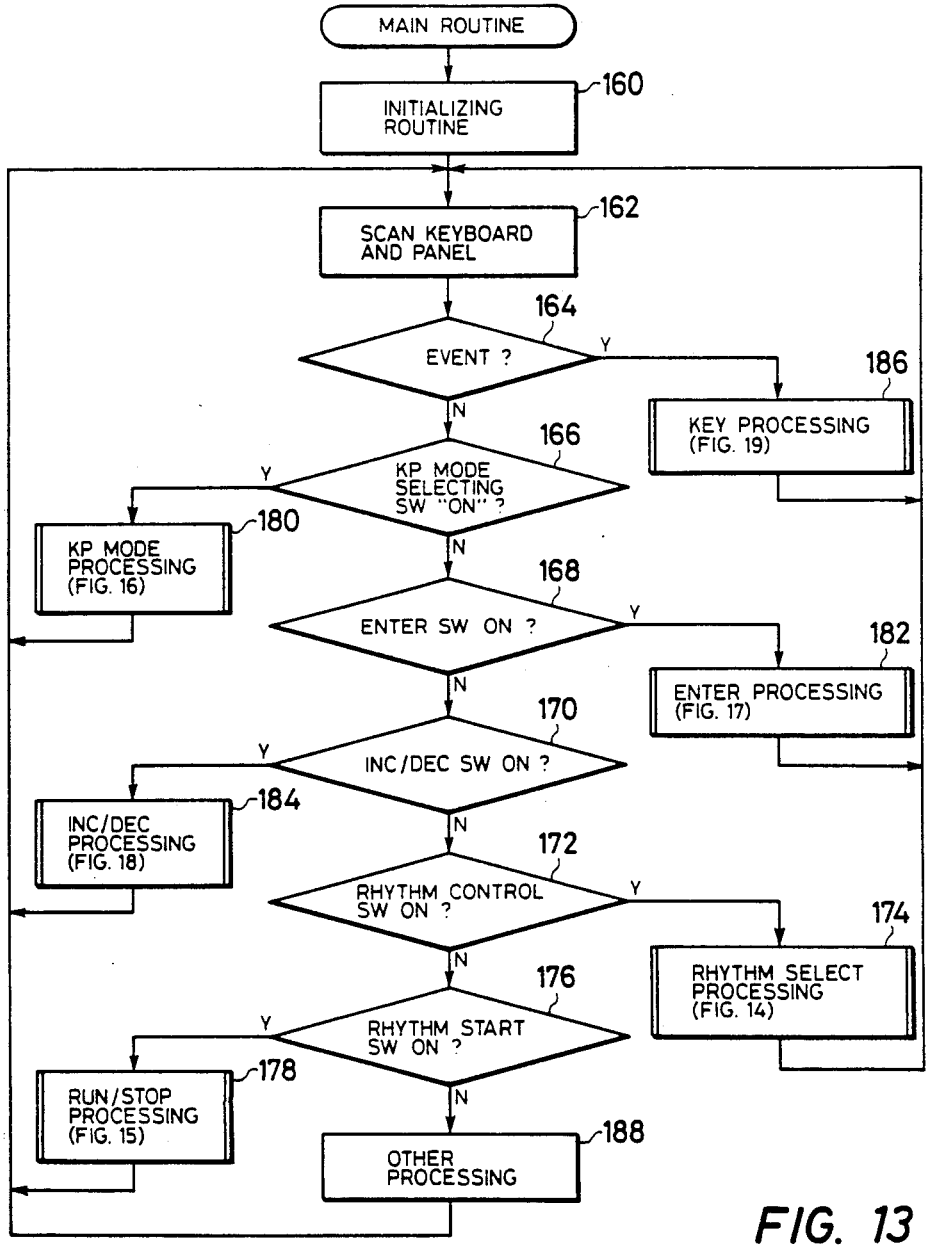
FIG. 13 is a flow chart showing a main routine operation.

Main routine operation (FIG. 13)

FIG. 13 shows the flow of the main routine processing.

To begin with, in Step 160, an initializing routine operation is carried out to initially set various respective registers and flags. With this, processing moves onto Step 162, wherein respective key switches of the respective keyboards and manual belonging to the keyboard circuit 112 as well as respective operating manipulators provided on the panel face are scanned to detect key operation informations and panel operation informations.

Next, in Step 164, judgement is made whether there is key event (key-on or key-off). If the result of this judgement indicates no key event, (N), processing moves to Step 166.

In Step 166, judgement is made whether the KP mode selecting switch 146 has been turned on. If the result of this judgement indicates "not turned on", (N), processing advances to Step 168.

In Step 168, judgement is made whether the enter switch 142 has been actuated. If the result of this judgement indicates "not actuated", (N), processing moves onto Step 170, wherein whether the increment switch 138 or the decrement switch 140 has been turned on is judged. If the result of this judgement indicates "not turned on", (N), processing moves to Step 172.

In Step 172, judgement is made whether one of the rhythm control switches among the rhythm control switch group including a rhythm selecting switch 154, a fill-in switch 150 and a break switch 152 has been turned on. When a rhythm is to be performed, it is usual to select a rhythm first. Therefore, let us here assume that either one of the rhythm selecting switches has been turned on. Whereupon, the result of judgement made in Step 172 will become affirmative, (Y), and processing will move to Step 174.

In Step 174, rhythm selecting processing is carried out, which will be described later by referring to FIG. 14. By virtue of this processing done in Step 174, selection of a rhythm becomes feasible. After the Step 174, processing returns to Step 162.

In case the result of judgement in Step 172 is negative, (N), processing moves to Step 176, wherein judgement is made whether the rhythm start switch 148 has been actuated. Let us here assume that after either one of the rhythm selecting switches has been turned on as mentioned above, the rhythm start switch 148 is turned on. Whereupon, the result of judgement in Step 176 becomes affirmative, (Y), and processing advances to Step 178.

In Step 178, run/stop processing is carried out, which will be described later by referring to FIG. 15. By this processing in Step 178, the commencement of an automatic rhythm performance becomes feasible. After Step 178, processing returns to Step 162.

Next, let us assume here that the KP mode selecting switch 146 is turned on. Whereupon, the result of judgement in Step 166 becomes affirmative, (Y), and processing moves onto Step 180.

In Step 180, KP mode processing is carried out, which will be described later by referring to FIG. 16. This Step 180 will enable a KP mode operation. After Step 180, processing returns to Step 162.

Next, let us assume that the enter switch 142 is turned on. Whereupon, the result of judgement in Step 168 becomes affirmative, (Y), and processing moves onto Step 182.

In Step 182, enter processing is carried out, which will be described later by referring to FIG. 17. This processing in Step 182 makes the assigning mode operation feasible. Subsequent to Step 182, processing returns to Step 162.

Let us next assume that either the increment switch 138 or the decrement switch 140 is turned on. Whereupon, the result of judgement made in Step 170 becomes affirmative, (Y), and processing moves onto Step 184.

In Step 184, increment/decrement processing is carried out, which will be described later by referring to FIG. 18. As a result of this processing done in Step 184, the selection of a rhythm tone source requiring assignment becomes feasible. After Step 184, processing returns to Step 162.

Next, let us assume that a key is depressed on either the upper keyboard, the lower keyboard or the foot pedal manual. Whereupon, the result of judgement in Step 164 becomes affirmative, (Y), and processing moves onto Step 186. Also, when the depressed key is released, processing moves onto Step 186 in a similar fashion as mentioned above.

In Step 186, key processing is carried out, which will be described later by referring to FIG. 19. The processing done in this Step 186 enables either the production of a keyboard performance tone or a manual rhythm tone, or the assignment of a rhythm tone source to a key. After Step 186, processing returns to Step 162.

When the result of judgement in each of the Steps 164, 166, 168, 170, 172 and 176 is negative, (N), processing moves onto Step 188, wherein other kinds of processing are carried out, and processing returns to Step 162.

Figure 14:
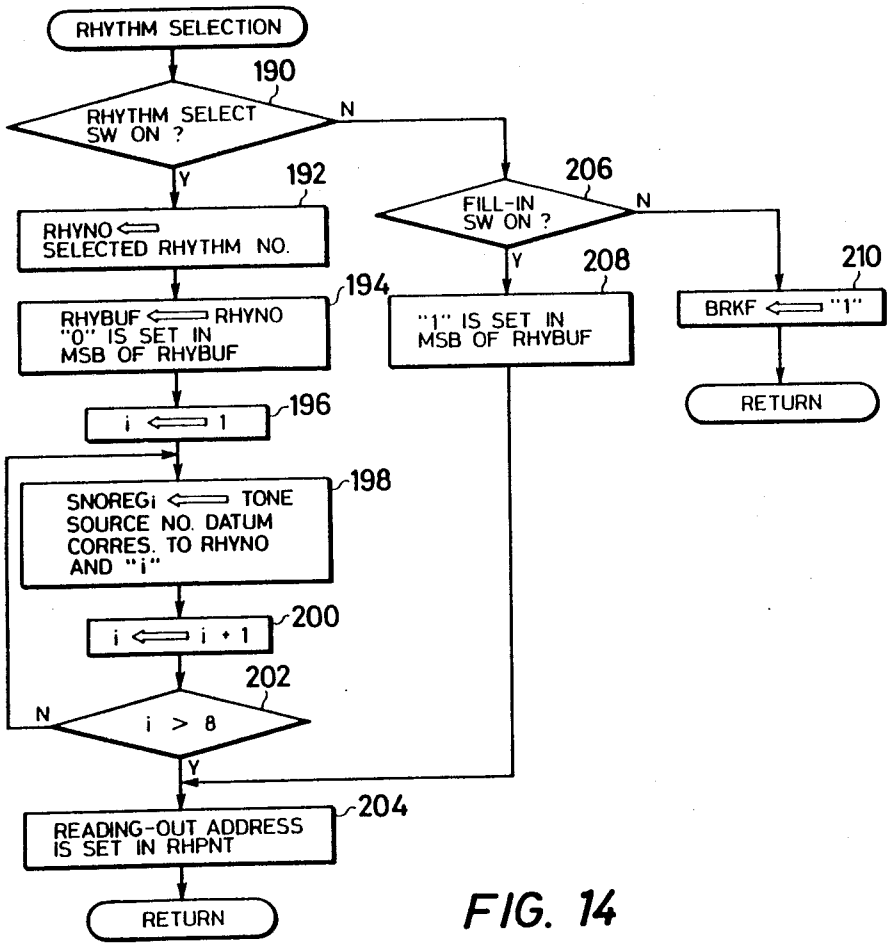
FIG. 14 is a flow chart showing a subroutine operation of rhythm selecting processing.

Rhythm selection processing sub-routine operation (FIG. 14)

In FIG. 14, it should be noted that, in Step 190 judgement is made whether one of the rhythm selecting switches 154 has been turned on, and if its actuation is indicated, (Y), processing moves to Step 192.

In Step 192, a rhythm number datum corresponding to the rhythm selected by the actuated rhythm selecting switch is written in the register RHYNO. With this, processing moves to Step 194.

In Step 194, the rhythm number datum stored in the register RHYNO is set in the lower three (3) bits of the buffer RHYBUF, and along therewith "0" (corresponding to the pattern "normal") is set in the most significant bit (MSB) of RHYBUF.

Next, in Step 196, "1" is set as a control variable "i". With this, processing advances to Step 198, wherein tone source number datum reading-out processing is carried out. More particularly, based on the rhythm number datum stored in the register RHYNO and the control variable "i" (corresponding to the channel number), a tone source number datum for one tone source is read out from the tone source number memory 122, and this datum is written in the first-positioned tone source number register $SNOREG_1$. Thereafter, in Step 200, "i" is upped by one (1), and then processing moves to Step 202, wherein judgement is made whether "i" is greater than "8" Initially, "i" becomes "2" in Step 200, so that the result of judgement in Step 202 becomes negative, (N), and processing returns to Step 198.

When the above-described reading-out processing is carried out for an amount of eight (8) tone sources, tone source number data for eight (8) tone sources with respect to the selected rhythm are stored in the registers $SNOREG_1 \sim SNOREG_8$. Also, the result of judgement in Step 202 becomes affirmative, (Y), and processing moves to Step 204.

In Step 204, reading-out addresses are set in the pointer RHPNT in order to enable the reading-out of data from the rhythm pattern memory 124. That is, if the flag RUN indicates "0" (cease of rhythm), a leading address is set in the pointer RHPNT so as to read out the rhythm pattern corresponding to the contents of the buffer RHYBUF, starting at the beginning of the first beat of this rhythm pattern. Also, in case RUN indicates "1" (run of rhythm), a specific reading-out address is set in the pointer RHPNT so as to read out a rhythm pattern corresponding to the contents of the buffer RHYBUF in such a way as to resume the reading-out operation at the position where the reading-out of the preceding rhythm pattern ceases. Thereafter, processing returns to the routine operation of FIG. 13.

It should be noted here that, in the interrupt routine, the event data of the addresses which have been set in the pointer RHPNT are read out, and if there is coincidence between the tone-producing timing indicated by this event datum and the count value (either one of "0~47" within one bar) of the tempo counter counting tempo clock pulses, the tone source number datum contained in said event data is delivered out to $RHY \cdot G_{130}$ to drive a corresponding rhythm tone source. By repeating such an interrupt processing, it becomes possible to effect an automatic rhythm performance using a rhythm pattern corresponding to the selected rhythm.

In case the result of judgement in Step 190 is negative, (N), processing moves onto Step 206, wherein whether the fill-in switch 150 is turned on is judged. If the result of this judgement indicates "turned on", (Y), processing moves to Step 208, wherein "1" (corresponding to the type of pattern "fill-in") is set in the most significant bit (MSB) of the buffer RHYBUF. With this, processing advances to Step 204, wherein reading-out addresses are set in the pointer RHPNT in a manner similar to that described above in order to enable the reading-out of the rhythm pattern for fill-in, and thereafter processing returns to the routine operation of FIG. 13. As a result, if, for example, "waltz" has till then been performed in accordance with the rhythm pattern for normal play, the performance will thence be made in accordance with the rhythm pattern for fill-in. The performance of the fill-in rhythm is effected throughout the length of one bar. At the end of this bar, the most significant bit (MSB) of RHYBUF is reset to "0." For this reason, the rhythm pattern will be switched automatically from that for fill-in to the pattern for normal play.

In case the result of judgement in Step 206 is negative, (N), this means that the break switch 152 is turned on, so that the processing moves to Step 210. In this Step 210, "1" is set in the flag BRKF, and thereafter processing returns to the routine operation of FIG. 13. As a result, the automatic rhythm is rendered to a rest state. This rest state lasts throughout the length of one bar. At the end of this bar, BRKF is reset to "0". For this reason, the automatic rhythm performance is resumed.

Figure 15:
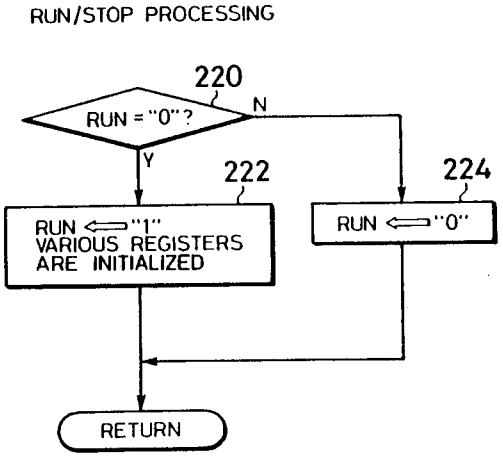
FIG. 15 is a flow chart showing a subroutine operation of run/stop processing.

Run/stop processing sub-routine operation (FIG. 15)

In FIG. 15, it should be noted that, in Step 220, judgement is made whether the flag RUN is "0" (cease of rhythm). If the result of judgement indicates "0", (Y), processing moves onto Step 222.

In Step 222, "1" is set in the flag RUN, and along therewith various registers (for example, the abovesaid tempo counter, etc.) associated with an automatic rhythm performance are initialized. As a result, an automatic rhythm performance is commenced.

In case the result of judgement in Step 220 is negative, (N), this means that the rhythm is running, and processing moves over to Step 224. In this Step 224, "0" is set in the flag RUN, and thereafter processing returns to the routine of FIG. 13. As a result, the automatic rhythm performance is brought to a halt.

Figure 16:
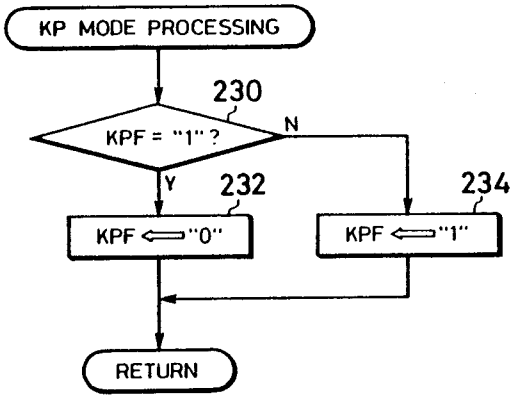
FIG. 16 is a flow chart showing a subroutine operation of key percussion (KP) mode processing.

KP mode processing sub-routine operation (FIG. 16)

In FIG. 16, it should be noted that, in Step 230, judgement is made whether the flag KPF indicates "1" (whether KP mode is indicated). If the result of this judgement is "1", (Y), processing moves over to Step 232, wherein "0" is set in KPF. And, processing returns to the routine operation of FIG. 13. As a result, KP mode is noted to have been released.

When the result of judgement in Step 230 is negative, (N), processing advances to Step 234, wherein "1" is set in KPF. And, processing returns to the main routine operation of FIG. 13. As a result, the KP mode operation becomes feasible.

Figure 17:
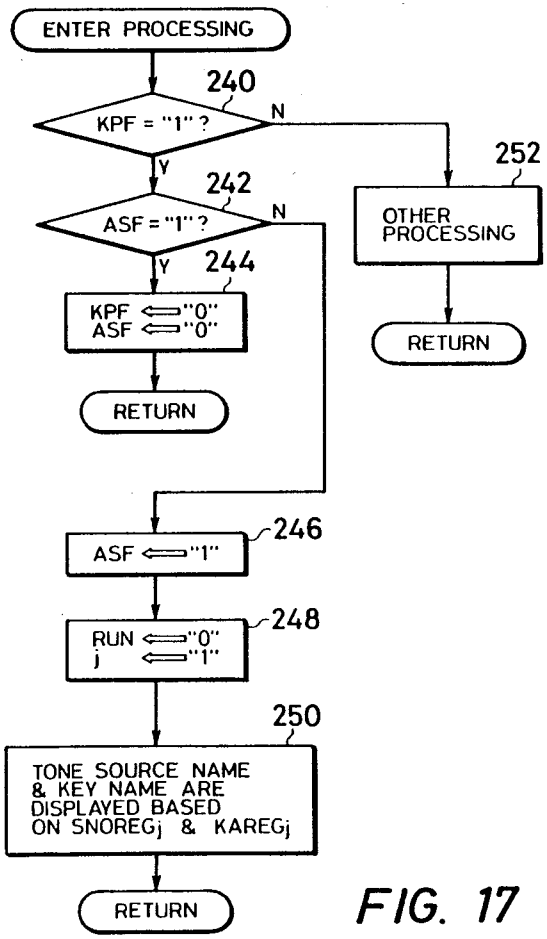
FIG. 17 is a flow chart showing a subroutine operation of enter processing.

Enter processing sub-routine operation (FIG. 17)

In FIG. 17, it should be noted that, in Step 240, judgement is made whether KPF indicates "1" (whether KP mode is indicated). If the result of this judgement is "1", (Y), processing moves onto Step 242, wherein judgement is made whether the flag ASF indicates "1" (whether the assignment mode is indicated). If the result of this judgement is affirmative, (Y), processing moves to Step 244, wherein "0" is set in KPF and ASF, respectively. And, processing returns to the routine operation of FIG. 13. As a result, both the KP mode and the assigning mode have now been released.

In case the result of judgement in Step 242 is negative, (N), processing advances to Step 246, wherein "1" is set in ASF. That is, when, user the KP mode, the enter switch 142 is turned on, the assigning mode is set.

Next, in Step 248, "0" is set in the flag RUN. This is intended to cause the automatic rhythm performance to be ceased throughout the period of the assigning mode. Also, "1" is set at a control variable "j", and thereafter processing moves to Step 250.

In Step 250, a menu for the assigning mode such as the one shown in FIG. 11 is displayed on the multiple menu display 136 which is comprised of, for example, a liquid crystal indicator. Moreover, at the tone source name indicating section 136A, there is displayed a tone source name (for example, "BD" in case of bass drum) corresponding to the contents of the j-th tone source number register $SNOREG_j$, while at the key name indicating section 136B, there is displayed a key name (for example "$C_3$" in case of $C_3$ key) in accordance with the contents of the j-th assigning key code register $KAREG_j$. However, in case operation has entered into the assigning mode without effecting such a rhythm tone source assigning operation as that which will be described later, nothing will be displayed at the key name indicating section 136B, because no key code is stored in $KAREG_j$. After Step 250, processing returns to the main routine operation of FIG. 13.

In case the result of judgement in Step 240 is negative, (N), processing advances to Step 252, wherein other kinds of processing are carried out. For example, there is carried out such a processing that a tone color selecting menu is displayed on the multiple menu diplay 136 to allow the selection of a tone color. After Step 252, processing returns to the main routine operation of FIG. 13.

Figure 18:
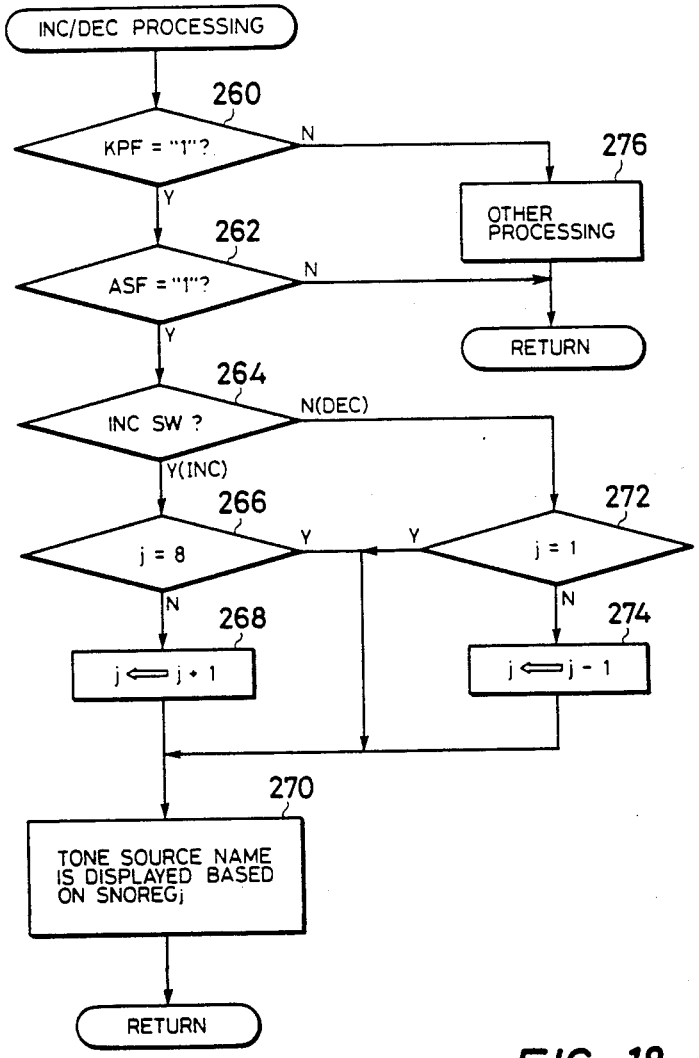
FIG. 18 is a flow chart showing a subroutine operation of increment/decrement (INC/DEC) processing.

INC/DEC processing sub-routine operation (FIG. 18)

In FIG. 18, it should be noted that, in Step 260, judgement is made whether KPF is "1", and if it indicates "1", (Y), processing moves onto Step 262. In Step 262, judgement is made whether ASF is "1", and if it is "1", (Y), processing moves onto Step 264.

In Step 264, judgement is made whether the increment switch 138 is turned on. If the result of this judgement is affirmative, (Y), processing moves onto Step 266, wherein whether "j" indicates "8" is judged. For example, in case, immediately after "j" has been rendered to "1" in the above-mentioned Step 248, the increment switch 138 is turned on, the result of judgement in Step 266 will become negative, (N), and processing moves to Step 268.

In Step 268, "j" is upped by one (1). And, processing moves onto Step 270, wherein a tone source name corresponding to the contents of the j-th tone source number register $SNOREG_j$ is displayed at the tone source name indicating section 136A. Thereafter, processing returns to the main routine operation of FIG. 13.

By the operation that, after rendering j=1 as stated above, processing passes through the operating in Step 268 each time the increment switch 138 is turned on, tone source names corresponding to the contents of the registers $SNOREG_2 \sim SNOREG_8$ can be displayed in succession at the tone source name indicating section 136A.

When, after "j" has been rendered to "8", processing comes to Step 266, the result of judgement will become affirmative, (Y), and processing moves to Step 270 without passing through Step 268. Accordingly, in this case, a tone source name corresponding to the contents of the register $SNOREG_8$ is displayed in a manner same as that of the preceding Step. And, after this, no matter how many times the increment switch 138 is turned on, the displayed tone source name will not change.

In case the result of judgement in Step 264 is negative, (N), this means that the decrement switch 140 is turned on, so that processing will move onto Step 272. in this Step 272, judgement is made whether "j" is "1", and if it is not "1", (N), processing moves onto Step 274.

In Step 274, "j" is downed by "1", and then processing moves to Step 270. Accordingly, in such a case as j="8" in Step 272, there will be displayed a tone source name corresponding to the contents of the register $SNOREG_7$. Thereafter, in the same manner as that mentioned above, by passing through the processing in Step 274 each time the decrement switch 140 is turned on, it is possible to display successively those tone source names corresponding to the contents of the registers $SNOREG_6 \sim SNOREG_1$.

When, after "j" has been rendered to "1", processing arrives at Step 272, the result of judgement in this Step becomes affirmative, (Y), and processing moves onto Step 270. Accordingly, after this, the displayed tone source name will not change no matter how many times the decrement switch 140 is turned on.

In case the judgement made in Step 260 does not indicate KPF="1", (N), processing moves to Step 276 wherein other kinds of processing are carried out. For example, in case a menu for tone color selection is being displayed as stated above, there is effected, for example, a processing for altering the tone color name which is being displayed. After Step 276, processing returns to the main routines operation of FIG. 13. It should be noted here that, even when the result of judgement in Step 262 does not indicate ASF="1", (N), processing will likewises return to the routine of FIG. 13.

Figure 19:
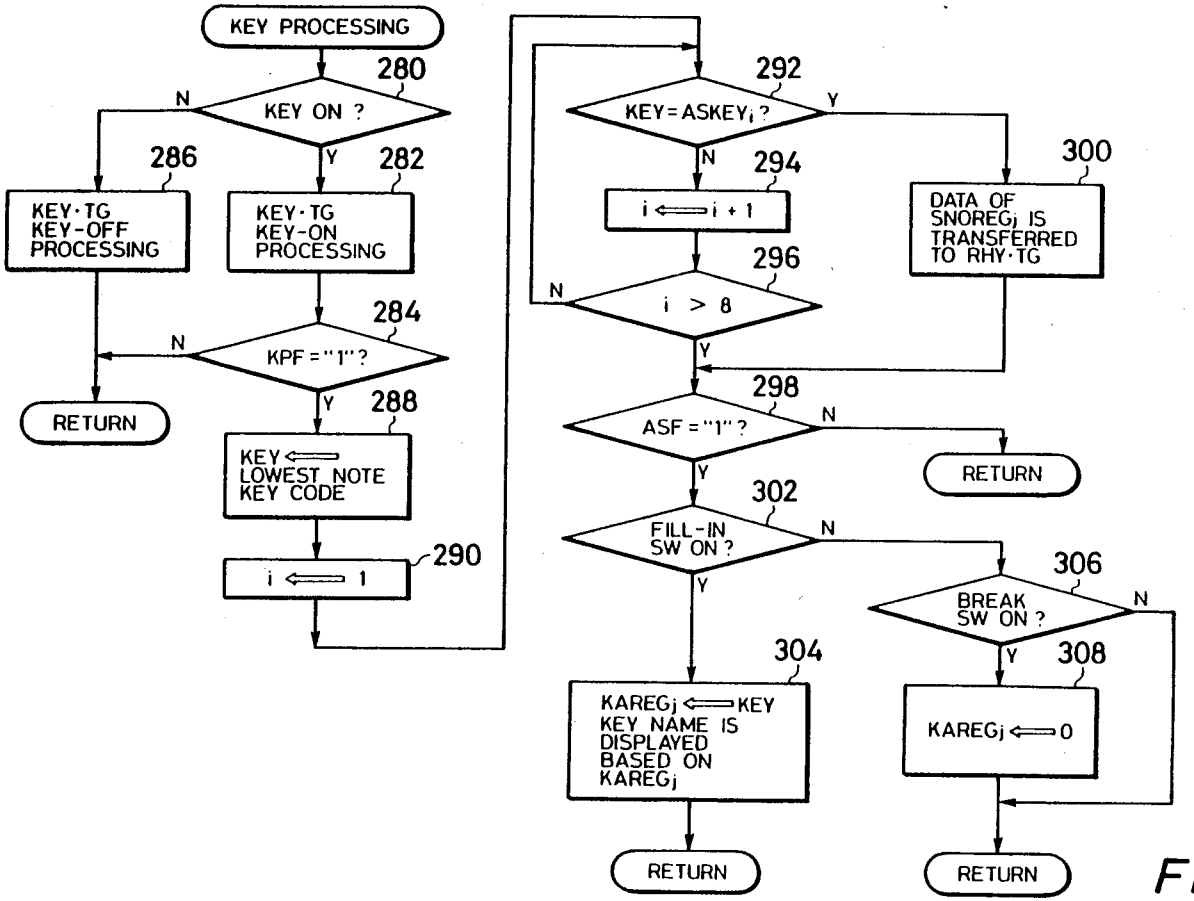
FIG. 19 is a flow chart showing a subroutine operation of key processing.

Key processing sub-routine (FIG. 19)

In FIG. 19, it should be noted that, in Step 280, judgement is made whether there is "key-on", and if result thereof indicates a "key-on", (Y), processing moves over to Step 282, wherein a key-on processing of the KEY·TG 128 is carried out. That is, a key code datum corresponding to the depressed key is delivered out to KEY·TG 128, to thereby produce a corresponding tone. And, processing moves over to Step 284, wherein judgement is made whether KPF="1". If it is not "1", (N), processing return to the main routine operating of FIG. 13.

In case the result of judgement in Step 280 does not indicate a "key-on", (N), this means a "key-off", so the processing moves to Step 286. In this Step 286, a "key-off" processing of KEY·TG 128 is carried out to effect the ceasing of the production of the tone which is being sounded out. And, processing returns to the main routine of FIG. 13.

In case the indication is not KPF="1" (not the key percussion mode) as stated above, it is possible to produce a keyboard performance tone by using a keyboard belonging to the keyboard circuit 112.

In case the result of judgement indicates KPF="1", (Y), there is carried out such a processing intended for a manual rhythm tone production or a rhythm tone source assignment as will be stated below. In this case, if it is not desired to produce a tone through the processing Step 282, it is only necessary to adjust the tone volume manipulator not shown to render the tone non-audible.

After Step 284, processing moves onto Step 288, wherein the key code datum corresponding to the lowest note key among the depressed keys (in case only one key is depressed, the key code datum or operating manipulator identifying datum therefor) is stored in the register KEY. And, after setting "1" as a control variable "i" in Step 290, processing moves over to Step 292.

In Step 292, judgement is made whether there is a coincidence between the key code datum of the register KEY and the key code datum of the i-th assigning key code register $KAREG_i$. If the result of this judgement indicates no coincidence, (N), processing moves over to Step 294, wherein "i" is upped by one (1). With this, processing moves to Step 296.

In Step 296, judgement is made whether "i" is greater than "8" It should be noted here that initially "i" is rendered to "2" in Step 294, so that the result of judgement in Step 296 becomes negative, (N), and processing returns to Step 292. When the processing which passes through the Step 296 is repeated for an amount of eight (8) tone sources, the result of judgement in Step 296 becomes affirmative, (Y), and processing moves to Step 298. This represents the instance wherein no key code datum has been stored in $KAREG_1 \sim KAREG_8$ (no assignment of rhythm tone source) or the instance wherein a key which is different from the assigned one is depressed.

In case the result of judgement in Step 292 is affirmative, (Y), processing moves over to Step 300, wherein manual rhythm tone producing processing is carried out. That is, a tone source number datum stored in the tone source number register $SNOREG_i$ corresponding to the register $KAREG_i$ is delivered out to RHY·TG 130 to cause a corresponding rhythm tone to be produced. And, processing moves over to Step 298.

In Step 298, judgement is made whether ASF is "1", and if it is not "1", (N), processing returns to the main routine operation of FIG. 13. And, when processing arrives at Step 292 again, if the result of judgement in this Step is negative, (N), processing returns to Step 292 after passing through Steps 294 and 296. If the result of judgement in Step 292 is affirmative, (Y), processing moves over to Step 300. Accordingly, in case of the key percussion mode when KPF="1" and ASF="0", it is possible to use eight (8) keys corresponding to the key code data stored in the registers $KAREG_1 \sim KAREG_8$ to effect a hand percussion performance. In this case, it is also possible to effect a hand percussion performance in concert with an automatic rhythm performance.

In case the result of judgement in Step 298 is affirmative, (Y), this means that the assigning mode has been set, so that the processing moves over to Step 302. In this Step 302, judgement is made whether the fill-in switch 150 is turned on. If it has been turned on,(Y), processing advances to Step 304.

In Step 304, the key code datum of the register KEY is written in the register $KAREG_i$ and along therewith a key name corresponding to the contents of $KAREG_j$ is displayed at the key name indicating section 136B. The register $KAREG_j$ is a register having storage regions respectively corresponding to the storage regions of the tone source number register $SNOREG_j$ which, in turn, corresponds to the tone source name being displayed in Step 270 of FIG. 18. Accordingly, when the user sees the tone source name being on display and depresses both a desired key and the fill-in switch 150 at the same time, a rhythm tone source corresponding to the tone source name on display is assigned to said key, and the key name to which the assignment has been made is displayed also. After the Step 304, processing returns to the main routine operation of FIG. 13. And, by effecting such an assigning operation as mentioned above by displaying a different tone source name each time, it is possible to assign to eight (8) keys the eight (8) rhythm tone sources with respect to a desired rhythm type.

In case the result of judgement in Step 302 is negative, (N), processing moves over to Step 306, wherein judgement is made whether the break switch 152 is turned on. If it has been turned on, (Y), processing advances to Step 308.

In Step 308, "0" is set in the register $KAREG_j$ and its key code datum is erased. Accordingly, when the key corresponding to the key name on display based on $KAREG_j$ and also the break switch 152 are depressed simultaneously, the tone source assignment made to said key is released, and with this the display of this key name will become extinguished also. Thereafter, processing will return to the main routine operation of FIG. 13. It should be noted here that even when the result of judgement is Step 306 is negative, (N), processing will return to the main routine of FIG. 13.

In this instant embodiment, arrangement has been made that a hand percussion performance is effected by using the keyboard to whose key a rhythm tone source has been assigned. It should be noted here that arrangement may be provided so that the rhythm pattern memory 124 comprised of a RAM, or otherwise another RAM different from the memory 124 is provided, so that said keyboard is used to effect the operation of writing a tone producing timing in the RAM and writing a tone source designating data corresponding to the rhythm tone sources requiring pronunciation (i.e. the so-called rhythm sequence programing). And, an automatic rhythm performance may be effected by the use of a rhythm pattern which is composed of a series of tone source designating data which have been written in the RAM. Although the invention has been described with respect to assignment of rhythm tone sources in correspondence to actuated input operating manipulators, it will be appreciated that the invention more broadly encompasses designation of a manipulator to be assigned, regardless of whether such designation is accomplished by manipulator actuation.

What is claimed is:

1. A rhythm tone source assigning apparatus for use in an electronic musical instrument, comprising:

a plurality of input operating manipulators for being assigned with either one of a plurality of mutually different rhythm tone sources;

memory means associated with each one of said plurality of input operating manipulators and containing therein a plurality of storing regions corresponding to said plurality of input operating manipulators, respectively;

selecting means associated with said plurality of rhythm tone sources for selecting either one of said plurality of rhythm tone sources which is to be assigned to said plurality of input operating manipulators;

designating means for designating an input operating manipulator to which the selected rhythm tone source is assigned; and writing-in means associated with said memory means for writing a rhythm tone source designating datum corresponding to a rhythm tone source selected by said selecting means in a storing region corresponding to the designated input operating manipulator among said plurality of storing regions.

2. A rhythm tone source assigning apparatus for use in an electronic musical instrument, comprising:

rhythm selecting means for selecting a desired one from among a plurality of rhythms;

memory means having a plurality of storing regions corresponding to said plurality of rhythms;

writing-in means associated with said memory means for writing a rhythm tone source designating datum in each one of said storing regions of said memory means in accordance with a rhythm selected by said rhythm selecting means;

rhythm tone source selecting means associated with said memory means for selecting a rhythm tone source to be assigned, by reading out a rhythm tone source designating datum from either one of said storing regions;

a plurality of input operating manipulators associated with said rhythm tone source selecting means for being assigned with a rhythm tone source selected by said rhythm tone source selecting means;

designating means for designating an input operating manipulator to which the selected rhythm tone source is assigned; and assigning means associated with said plurality of input operating manipulators for assigning a selected rhythm tone source to the designated one of said plurality of input operating manipulators.

3. A rhythm tone source assigning apparatus for use in an electronic musical instrument, comprising:

rhythm selecting means for selecting a desired one from among a plurality of rhythms;

first memory means having a plurality of storing regions corresponding to said plurality of rhythms;

first writing-in means associated with said first memory means for writing a rhythm tone source designating datum in each of said storing regions of said first memory means in accordance with a rhythm selected by said rhythm selecting means;

rhythm tone source selecting means associated with said first memory means for selecting a rhythm tone source to be assigned by reading out a rhythm tone source designating datum from one of the plurality of storing regions of said first memory means;

second memory means having a plurality of storing regions corresponding, respectively, to the plurality of storing regions of said first memory means;

a plurality of input operating manipulators associated with said rhythm tone source selecting means for being assigned with a rhythm tone source selected by said rhythm tone source selecting means;

second writing-in means associated with said second memory means for writing an operating manipulator identifying datum corresponding to identified one of said plurality of input operating manipulators in a storing region of said second memory means corresponding to said one storing region of said first memory means from which region has been read out a rhythm tone source designating datum, when a rhythm tone source to be assigned to either one of said plurality of input manipulators has been selected;

judging means associated with said plurality of input operating manipulators for judging that an operating manipulator identifying datum for actuated one of said plurality of input operating manipulators has been written in said second memory means when a rhythm tone source to be assigned has not been selected; and reading-out means associated with said judging means for reading out from said first memory means, when the result of judgment made by said judging means is affirmative, a rhythm tone source designating datum corresponding to the operating manipulator identifying datum related to said judgment.

* * * * *